US007900695B2

(12) United States Patent
Unsgaard

(10) Patent No.: US 7,900,695 B2
(45) Date of Patent: Mar. 8, 2011

(54) WELL PUMP DEVICE

(76) Inventor: Tom Unsgaard, Stavanger (NO)

( * ) Notice: Subject to any disclaimer, the term of this patent is extended or adjusted under 35 U.S.C. 154(b) by 265 days.

(21) Appl. No.: 11/665,400

(22) PCT Filed: Oct. 18, 2005

(86) PCT No.: PCT/NO2005/000390

§ 371 (c)(1),
(2), (4) Date: Sep. 17, 2007

(87) PCT Pub. No.: WO2006/043823

PCT Pub. Date: Apr. 27, 2006

(65) Prior Publication Data

US 2008/0115927 A1 May 22, 2008

(30) Foreign Application Priority Data

Oct. 19, 2004 (NO) ..... 20044418

(51) Int. Cl.
*E21B 31/00* (2006.01)

(52) U.S. Cl. ..... 166/99; 166/383; 166/301; 166/109

(58) Field of Classification Search ..... 166/301, 166/383, 99, 109
See application file for complete search history.

(56) References Cited

U.S. PATENT DOCUMENTS

| | | | | |
|---|---|---|---|---|
| 2,732,901 | A * | 1/1956 | Davis | 166/98 |
| 6,095,583 | A * | 8/2000 | Beeman et al. | 294/86.15 |
| 6,168,388 | B1 * | 1/2001 | Hughes et al. | 417/245 |
| 6,427,776 | B1 * | 8/2002 | Hoffman et al. | 166/311 |

FOREIGN PATENT DOCUMENTS

| | | |
|---|---|---|
| GB | 2264147 A | 8/1993 |
| GB | 2331536 A | 5/1999 |

* cited by examiner

*Primary Examiner* — Jennifer H Gay
*Assistant Examiner* — Elizabeth C Gottlieb
(74) *Attorney, Agent, or Firm* — Patents+TMS, P.C.

(57) ABSTRACT

A well pump device is introduced into a well and connects to a wireline to receive electrical energy from the surface. An electrically driven feed pump connects to and delivers driving fluid to the driving side of an ejector. A hydraulic apparatus uses the well pump device as a pulling tool.

1 Claim, 2 Drawing Sheets

WELL PUMP DEVICE

Figure 1:
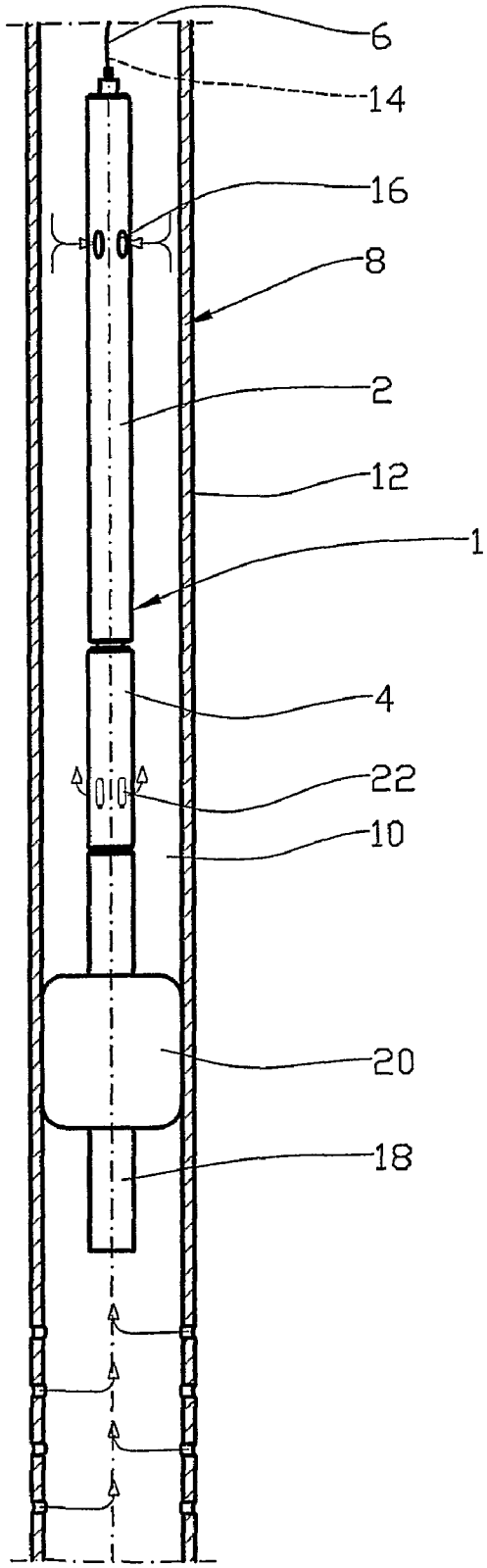

This invention regards a well pump for use in a subsurface well. In particular, it regards a well pump comprising a feed pump that delivers driving fluid to an ejector (jet pump), and where the ejector is, directly or indirectly, especially suited for use during servicing operations in a subsurface well.

When carrying out service work in a subsurface well it is sometimes necessary to assist the production up to a normal level from a relatively low pressure well, or to carry out pulling operations in the well.

According to prior art it is customary when starting up production from a killed well, to move coiled tubing into the well and then pump gas such as nitrogen down via the coiled tubing and thereby reduce the static pressure in the well. In many cases, pulling operations are also carried out by use of coiled tubing.

Coiled tubing operations of this type are relatively time consuming and costly.

The object of the invention is to remedy or reduce at least one of the disadvantages of prior art.

The object is achieved in accordance with the invention, by the characteristics stated in the description below and in the following claims.

A well pump comprising an electrically driven feed pump and an ejector is placed in a well near the site of operation. The feed pump is connected to a wireline and receives electrical energy via a line from the surface. The feed pump pumps well fluid from the well pump surroundings to the driving side of an ejector. The main outlet from the ejector is connected to an auxiliary apparatus and delivers fluid to the well pump surroundings.

When utilization the well pump in a start up operation in a well, the auxiliary apparatus comprises an inlet pipe to the ejector, the inlet pipe being provided with a packing. The packing is arranged to seal an annulus between the inlet pipe and the wall or the casing of the well.

When initiating or stimulating production from a well, the feed pump that drives the ejector is started up, thereby causing fluid to flow from the well formation via the inlet pipe and the ejector, through a pressure increase in the ejector, past the sealing packing and on up to the surface. The ejector is relatively insensitive to contaminants in the well fluid.

In another embodiment in which the well pump is used as a pulling tool, the well pump is provided with an auxiliary apparatus comprising a hydraulic cylinder with a piston and a piston rod. The upper cylinder chamber of the cylinder is connected to the ejector inlet. When the ejector reduces the pressure in the upper cylinder chamber the piston and piston rod are displaced upwards, the static pressure in the well acting on the underside of the piston.

The piston rod is attached to an object to be pulled. Starting and stopping the feed pump will make the pulling tool repeat the pulling operation.

The well pump with the auxiliary apparatus is also well suited for transport into the well by means of e.g. a well tractor.

Figure 2:
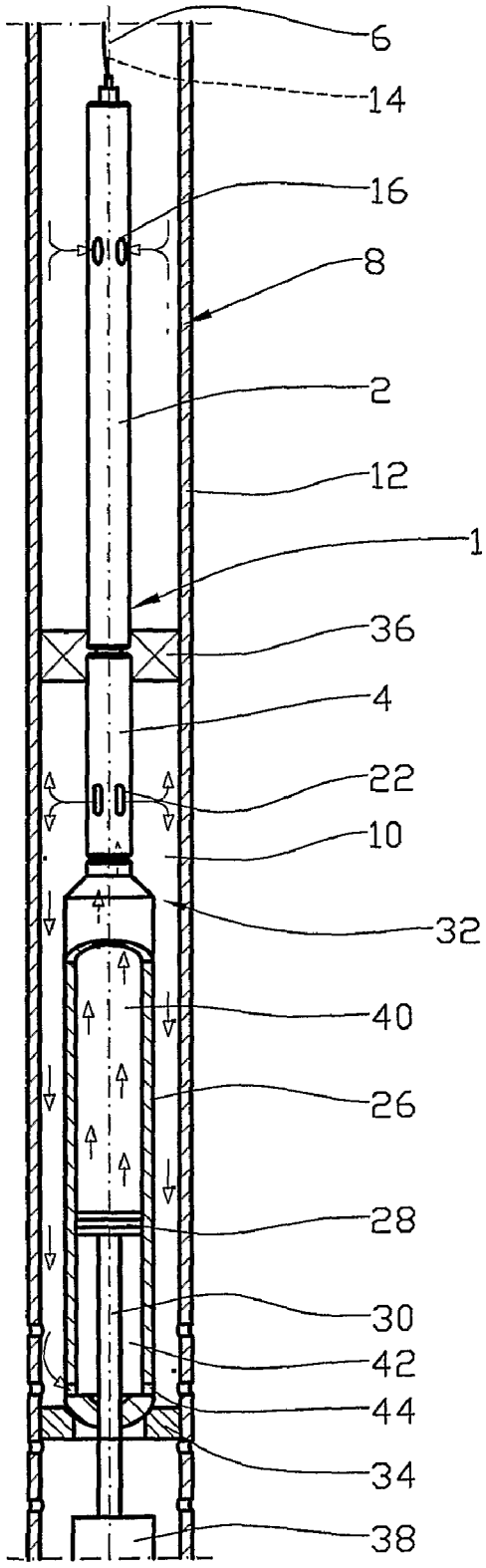

The following describes a non-limiting example of a preferred embodiment illustrated in the accompanying drawings, in which:

FIG. 1 shows a well pump with a connected inlet pipe and packing in a well, with arrows indicating fluid flow paths; and FIG. 2 shows the well pump with a connected pulling cylinder.

In the drawings, reference number 1 denotes a well pump comprising a feed pump 2 and an ejector 4. The well pump 1 is connected to the lower end portion of a wireline 6 and is arranged in a well 8. There is an annulus 10 between the casing 12 of the well 8 and the well pump 1.

The feed pump 2, which receives electrical energy from the surface via a line 14, is fed with fluid from the annulus 10 via feed openings 16. From the feed pump 2, the fluid flows via an inlet passage (not shown) to the driving side of the ejector 4.

FIG. 1 shows the well pump connected to an inlet pipe 18 which is fitted with an external packing 20 that seals against the casing 12.

The production from the well 8 can be enhanced by well fluid flowing in through the inlet pipe 18, through the ejector 4 and out into the annulus 10 via an outlet 22.

The ejector 4 aids in reducing the pressure below the packing 20 in the well casing, whereby the inflow to the casing 12 is stimulated.

In another embodiment, see FIG. 2, the well pump is connected to a hydraulic cylinder 26 provided with a sealing piston 28 and a piston rod 30. Together, the well pump 1 and the cylinder 26 form a downhole pulling tool 32.

During pulling operations, the pulling tool 32 is held in the well by a shoulder 34 or a tie bolt 36.

When pulling an object 38 connected to the piston 30, the pressure in the upper chamber 40 of the cylinder 26 is reduced by the well pump 1, the upper chamber 40 communicating with the ejector 4. The static pressure in the well 8 acts in the lower chamber 42 of the cylinder 26 and against the underside of the piston 28 via openings 44 in the wall of the cylinder 26, causing the piston 28 and thus the piston rod 30 and the object 38 to be displaced upwards.

The invention claimed is:

1. A pulling tool for introduction in a well to pull an object from the well wherein the pulling tool is introduced in the well with a wireline, the pulling tool comprising:

at least one of a tie bolt and a shoulder for holding the pulling tool in the well;

an ejector having a driving side and an inlet;

a feed pump that is electrically driven wherein the feed pump is connected to the driving side of the ejector;

a hydraulic apparatus connected to the ejector wherein the hydraulic apparatus has a hydraulic cylinder, a piston and a piston rod wherein the piston rod is connected to the piston and further wherein the piston rod is attachable to the object wherein the hydraulic cylinder has an upper chamber and a lower chamber defined by the piston positioned between the upper chamber and the lower chamber wherein the upper chamber has a hydraulic pressure controlled by the ejector and the feed pump wherein the upper chamber is connected to and communicates with the inlet of the ejector and further wherein the lower chamber communicates with the well wherein a reduction in the hydraulic pressure within the upper chamber by the ejector and the feed pump results in an upward displacement of the piston, the piston rod and the object.

* * * * *